US011555356B2

(12) United States Patent
Pratt et al.

(10) Patent No.: US 11,555,356 B2
(45) Date of Patent: Jan. 17, 2023

(54) DOWNHOLE VIBRATION AND SHOCK ABSORBING DEVICE

(71) Applicant: EXTENSIVE ENERGY TECHNOLOGIES PARTNERSHIP, Calgary (CA)

(72) Inventors: F. Dale Pratt, Calgary (CA); Kenneth A. Lambe, Calgary (CA); Doru Gorzo, Calgary (CA)

(73) Assignee: Extensive Energy Technologies Partnership, Calgary (CA)

( * ) Notice: Subject to any disclaimer, the term of this patent is extended or adjusted under 35 U.S.C. 154(b) by 0 days.

(21) Appl. No.: 17/102,684

(22) Filed: Nov. 24, 2020

(65) Prior Publication Data

US 2021/0156205 A1 May 27, 2021

Related U.S. Application Data

(60) Provisional application No. 63/010,845, filed on Apr. 16, 2020, provisional application No. 62/940,015, filed on Nov. 25, 2019.

(51) Int. Cl.
*E21B 17/07* (2006.01)
*E21B 47/017* (2012.01)

(52) U.S. Cl.
CPC ..... *E21B 17/07* (2013.01); *E21B 47/017* (2020.05)

(58) Field of Classification Search
CPC ..... E21B 17/07; E21B 47/013; E21B 47/017; E21B 17/10
See application file for complete search history.

(56) References Cited

U.S. PATENT DOCUMENTS

| | | | | |
|---|---|---|---|---|
| 3,156,106 | A * | 11/1964 | Crane | E21B 17/073 175/323 |
| 4,932,471 | A * | 6/1990 | Tucker | E21B 47/07 166/64 |
| 5,833,541 | A * | 11/1998 | Turner | F16D 3/74 464/20 |
| 9,187,997 | B2 | 11/2015 | Cramer | |
| 2013/0000983 | A1 * | 1/2013 | Hansen | E21B 47/017 175/57 |
| 2017/0044845 | A1 * | 2/2017 | Deere | E21B 17/10 |
| 2018/0179830 | A1 | 6/2018 | Konschuh | |
| 2019/0119994 | A1 | 4/2019 | Deere et al. | |

FOREIGN PATENT DOCUMENTS

CA 2735619 A1 9/2012

* cited by examiner

*Primary Examiner* — Christopher J Sebesta
*Assistant Examiner* — Lamia Quaim
(74) *Attorney, Agent, or Firm* — Heslin Rothenberg Farley & Mesiti P.C.; Victor A. Cardona, Esq.

(57) ABSTRACT

A snubber device for reducing shocks and vibrations in a downhole tool. The snubber includes a main body extending between upper and lower connector ends. The main body is defined by one or more cut-out portions. One or more elastomeric elements are held within the one or more cut-out portions. The cut-out portions provide flexibility to the main body. The elastomeric elements absorb shocks and vibrations and are conveniently replaceable when excessive wear reduces their shock and vibration absorbing capacity.

19 Claims, 12 Drawing Sheets

DOWNHOLE VIBRATION AND SHOCK ABSORBING DEVICE

CROSS-REFERENCE TO RELATED APPLICATIONS

This application claims priority from U.S. Provisional Application Ser. No. 62/940,015, filed on Nov. 25, 2019 and U.S. Provisional Application Ser. No. 63/010,845, filed on Apr. 16, 2020, the entire disclosures of which are incorporated herein by reference.

FIELD

The technology relates to downhole operations such as drilling, completions and well logging and more particularly to devices for reducing damage to the sensitive components of downhole measuring systems.

BACKGROUND

Rotary drilling in earth formations is used to form boreholes for obtaining materials in the formations, such as hydrocarbons. Rotary drilling involves a drill bit disposed on a drilling end of a drill string that extends from the surface. The drill string is made up of a series of tubulars that are configured to allow fluid to flow between the surface and earth formation. Tools provided to support a process known as measurement-while-drilling (MWD) are typically located relatively close to the drill bit. Examples of such tools include gamma ray detectors, accelerometers, magnetometers, and various sensors for measuring density, porosity, pressure and other data as well as batteries required to provide power to any of these tools. Multiple tools for MWD or well logging may be grouped together in a system known as a bottom hole assembly. Such tools are also used in other downhole applications such as well completions.

During rotation of the drill bit using modern drilling techniques, downhole tools in the bottom hole assembly are invariably subjected to vibrations and mechanical shocks that can damage the downhole tools, thereby disrupting communication along the drill string, or connections between downhole tools and other downhole components. The electronic and mechanical devices in tools may be particularly sensitive to mechanical shock and vibration. Damage to electronics in downhole tools may reduce reliability and life of the tools. Failure of the tools can result in costly downtime due to halted drilling operations and tool repairs before drilling may resume. To reduce damage, and thus failures due to mechanical shock and vibration, the tools may be isolated from mechanical shocks by one or more shock absorbing devices, commonly called snubbers.

A snubber is generally a component which is configured to reduce tool damage and wear due to stresses caused by mechanical shock and vibration. Conventional snubbers reduce the mechanical shocks being transmitted along the longitudinal axis of a drill string from the direction of the drill bit through compressibility of the snubber material. The conventional snubber typically includes one or more springs or elastomeric rings configured to compress radially and longitudinally when exposed to mechanical shocks. The shock absorbing ability of the snubber is often a function the thickness and type of snubbing material and limited to high frequency dampening. As such, snubbers are typically disposed on the side of a downhole tool where mechanical shocks are most likely to be generated.

Examples of such snubbers are described in US Patent Publication Nos. 20190119994, 20180179830, U.S. Pat. No. 9,187,997, and Canadian Patent Publication No. CA 2,735,619, each of which is incorporated herein by reference in entirety.

There continues to be a need for improvements in devices such as snubbers for protection of downhole tools to reduce costs and improve low frequency dampening and stick-slip radial dampening.

SUMMARY

In accordance with one embodiment, there is provided a snubber device for reducing shocks and vibrations in a downhole tool. The snubber includes a main body extending between upper and lower connector ends. The main body is defined by one or more cut-out portions providing flexibility to the main body. The device includes one or more elastomeric elements dimensioned to be held within the one or more cut-out portions.

The main body may be generally cylindrical. The main body may be defined by having a central longitudinal bore extending therethrough to provide a passage for one or more conducting cables associated with the tool.

In some embodiments, either the upper connector portion or the lower connector portion comprises a reduced diameter portion terminating in a flange and the bore extends through the reduced diameter portion and the flange to extend the passage through the flange.

In some embodiments, the upper connector end is configured for connection to a battery module. The upper connector end may be provided as a reduced diameter cylindrical portion configured to connect to a tube holding a series of cells.

In some embodiments where the upper connector end is configured for connection to a battery module, the lower connector end includes a housing formed in the body within the bore for holding a cable adapter.

In some embodiments where the upper connector end is configured for connection to a battery module, the lower connector end comprises a reduced diameter portion terminating in a flange and the bore extends through the reduced diameter portion and the flange to extend the passage through the flange.

In some embodiments, the one or more cut-out portions is a single cut-out portion and the one or more elastomeric element is a single elastomeric element. The single cut-out portion may be a helical cut-out portion. In this embodiment, the single elastomeric element is a helical elastomeric element configured to fit within the helical cut-out portion.

In some embodiments, the helical cut-out portion extends to the bore and the helical elastomeric element extends inward within the helical cut-out portion to provide the bore with a continuously smooth inner sidewall. The helical cut-out portion may be equivalent to about 50% of the volume of the main body. The helical cut-out portion may be defined by helical turns having a width of about 0.12 inches (about 3.0 mm) to about 0.13 inches (about 3.3 mm).

In some embodiments, the main body and the upper and lower connector portions are of monolithic construction.

The elastomeric elements may have Shore A hardness between about 60 to about 90.

According to another embodiment, there is provided a snubber device for reducing shocks and vibrations in a downhole tool. The snubber may include a generally cylindrical main body extending between upper and lower connector ends, the main body defined by a helical cut-out portion, and a helical elastomeric element held within the helical cut-out portion.

According to another embodiment, there is provided a kit comprising a snubber device as described herein and a plurality of replacement elastomeric elements. The replacement elastomeric elements may include replacement elastomeric elements having different Shore A hardness.

BRIEF DESCRIPTION OF THE DRAWINGS

Various objects, features and advantages of the technology described herein will be apparent from the following description of particular embodiments, as illustrated in the accompanying drawings. The drawings are not necessarily to scale in all cases with emphasis instead being placed upon illustrating the principles of various embodiments of the technology. Similar reference numerals indicate similar components.

DETAILED DESCRIPTION

Introduction and Rationale

In the oil and gas industry, with the advent of polycrystalline diamond compact drill bits and agitators which create greater vibration and shock parameters, there is a need to make downhole tools and modules more reliable. "Downhole tools" are defined herein as any tool used for mining or drilling that is exposed to temperature and pressure and performs a logging, operating, or real-time monitoring function as a downhole tool. Examples of downhole tools include but are not limited to MWD measurement-while-drilling (MWD) tools, logging-while-drilling (LWD) tools, instrumented tools, recording tools, wireline tools, well abandonment tools, production tools electromagnetic (EM) tools, sonic tools, drill stem testing tools, and reservoir recovery tools. "Downhole modules" are used to support downhole functions. Downhole modules may include equipment such as gamma ray detectors, accelerometers, magnetometers, batteries and various sensors for measuring density, porosity, pressure and other data. Examples of downhole modules include, but are not limited to: battery modules, gamma ray detection modules, mud pulser driver control modules, EM transmitter modules, EM receiver modules, directional modules, sonic modules, rotary steerable modules, inc at bit modules, rotational inc modules, resistivity modules, annulus or borehole pressure modules, turbine generator modules, neutron density modules, and gyro orientation modules.

Such tools which are used while drilling operate as part of the drill string and are subjected to high levels of vibrations and shocks. These environmental factors cause downhole electronic devices to fail at a much higher rate than surface devices. Any failure of a downhole electronic device is costly since drilling operations typically must be stopped and the downhole tools must be retrieved and repaired or replaced. Such operations can require a few hours to a few days, and are therefore quite costly. Accordingly, any device that reduces the frequency at which down hole failures occur is desirable.

Figure 1:
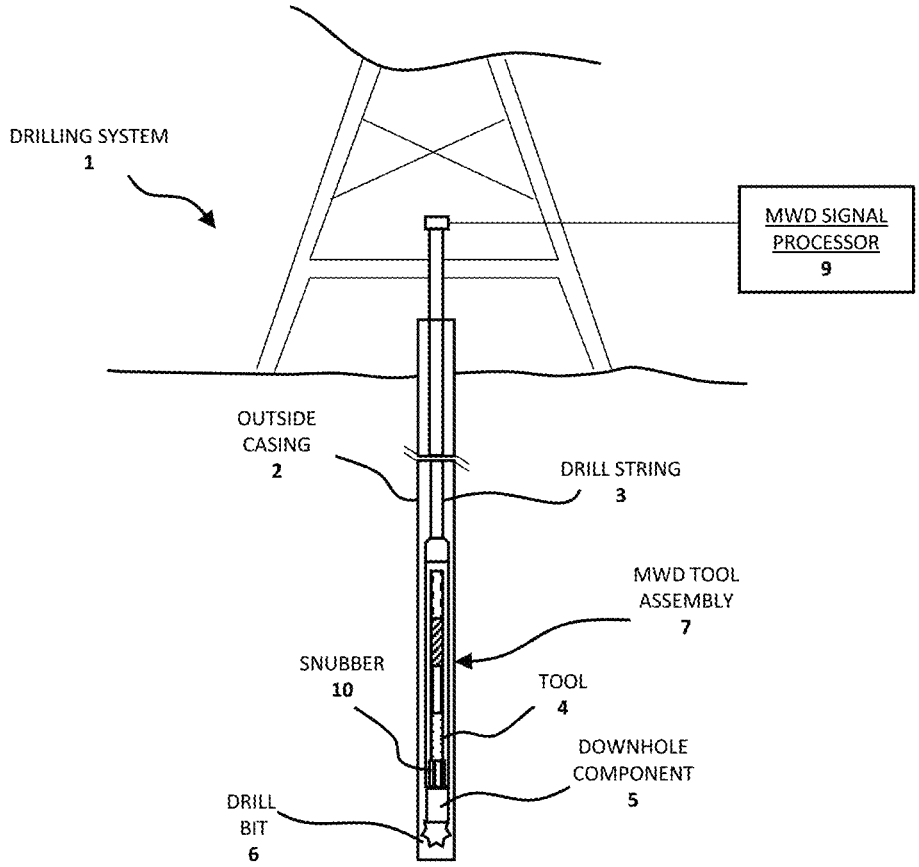
FIG. 1 is a schematic representation of a drilling system 1 showing the location of a snubber 10 between a lowermost MWD tool 4 of an MWD tool assembly 7 and a downhole component 5.

Most downhole electronic devices are operated with some means of isolating them from the shocks and vibrations that occur during drilling. Devices which are known in this field as "snubbers" provide some levels of shock and vibration protection. A typical placement of a snubber 10 in a drilling system 1 shown in the schematic illustration of FIG. 1. Drilling system 1 shows that the snubber 10 is installed as part of the drill string 3 within the outside casing 2 below a tool 4 in an MWD tool assembly 7 (which provides data to an MWD signal processor 9) and above a downhole component 5 which may be a bulkhead or other type of drill collar connector between the MWD tool assembly 7 and the drill bit 6. In other arrangements, one or more snubbers 10 may be provided between individual tools of the MWD tool assembly.

Figure 2A:
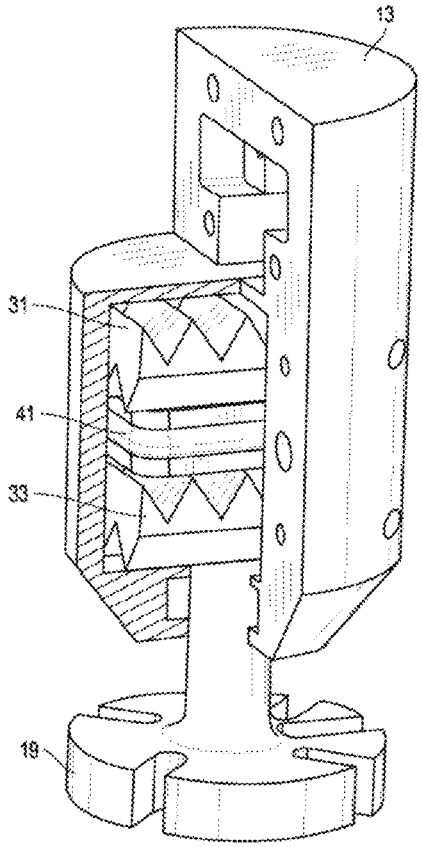
Fig. 2A (PRIOR ART)
FIG. 2A is a sectional side view of a prior art snubber device provided with axial spring elements 31, 33 and a radial spring element 41 associated with a piston extending into a cavity within the housing 13 of the snubber.
Figure 2B:
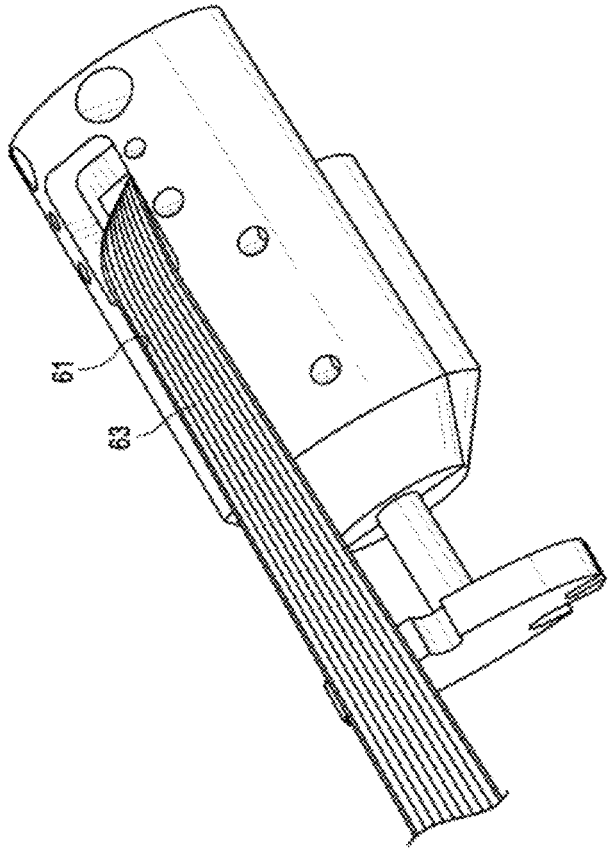
Fig. 2B (PRIOR ART)
FIG. 2B is a perspective view of the prior art snubber device of FIG. 2A showing a flat cable profile 61 (for protecting a set of cables 63) extending outward from a window in an upper connector portion of the prior art snubber device.

Shown in FIGS. 2A and 2B are two views of a prior art snubber which is described in U.S. Pat. No. 9,187,997 (incorporated herein by reference in its entirety). The cut away view of FIG. 2A indicates that a piston terminating in a flange 19 extends into a cavity within the snubber and that the piston is provided with axial spring elements 31, 33 and an intervening radial spring element 41. These spring elements 31, 33 and 41 are contained within a closed cavity in the body 13 of the snubber and are provided to absorb the radial and axial shocks and vibrations occurring during drilling, which cause movement of the piston within the closed chamber. Other examples of conventional snubbers include similar features, typically including a piston and springs, elastomers or other shock absorbing components. FIG. 2B shows an arrangement of the same snubber indicating how a collection 61 of individual conducting cables 63 associated with an electronics module extends outward from an upper window of the device and runs along the outer sidewall of the device extending down towards a lower component of the assembly (not shown). This is a conventional arrangement of cables bypassing the main body of a conventional snubber.

Snubbers are generally regarded as consumable devices which invariably wear out as a result of the continuous shocks and vibrations occurring during the drilling process. Conventional snubbers which have worn out are typically removed and sent to the manufacturer or tool repair lab for repair which will typically involve replacement of specialized parts. This process adds to the expense of operating snubbers in drilling operations.

The inventors have recognized that simplification of conventional snubber devices to reduce the extent of mechanical moving parts such as the pistons and springs which tend to be inconveniently placed within closed cavities of such devices would be a useful strategy for producing an improved snubber device which can be easily repaired in the field by workers who are not tool specialists, thereby dispensing with the requirement for specialized reconditioning and repair of worn out snubbers. With this objective in mind, it was recognized that a snubber duplicating the existing dimensions and form factor of conventional snubbers could be provided with minimal specialized parts by converting the main snubber body into a monolithic spring-like device by providing the main snubber body with one or more cut-out portions adapted to receive elastomeric elements. The configuration of the cut-out portions is selected with a view to providing a balance between flexibility and shock absorbing capacity introduced into the solid body. The cut-out portions provide flexibility to the otherwise rigid body which acts like a torsion bar to dampen radial vibration and shocks and the elastomeric elements provide the spring-like device with shock absorbing capacity. In this arrangement, the body may be provided with suitable connector ends configured for connection to the usual components, for example, at one end to an MWD tool and at the other end, to a downhole component such as a bulkhead or drill collar, for example. Alternatively, the inventive snubber may be connected within a string of MWD tools, for example between a directional sensor and a gamma electronics module if it is provided with appropriate end connectors. The inventive arrangement of placing one or more elastomeric elements within cut-out portions of the single piece snubber body provides a significantly simplified device which provides the required shock and vibration absorbing features with reduced numbers of parts and simplified manufacturing. Pistons, springs and other such shock absorbing components are not required and a closed cavity for holding such components is not required. It is therefore expected that an assessment and simple replacement of the elastomeric portion(s) thereof can be accomplished in a simplified manner by field workers, thereby increasing efficiency and reducing costs.

Embodiments of the devices described hereinbelow are of compact construction which allows them to be installed in any position in general proximity to downhole components such as a battery module, a gamma ray detector and a directional sensor and/or microprocessors and electronics associated therewith. In some arrangements, there may be as many as four or five snubbers installed between various tools and components of a downhole assembly to enhance the reduction of shocks and vibrations to protect these components.

Various embodiments will now be described with reference to FIGS. 3 to 7. A number of possible alternative features are introduced during the course of this description. It is to be understood that, according to the knowledge and judgment of persons skilled in the art, such alternative features may be substituted in various combinations to arrive at different embodiments.

Figure 3A:
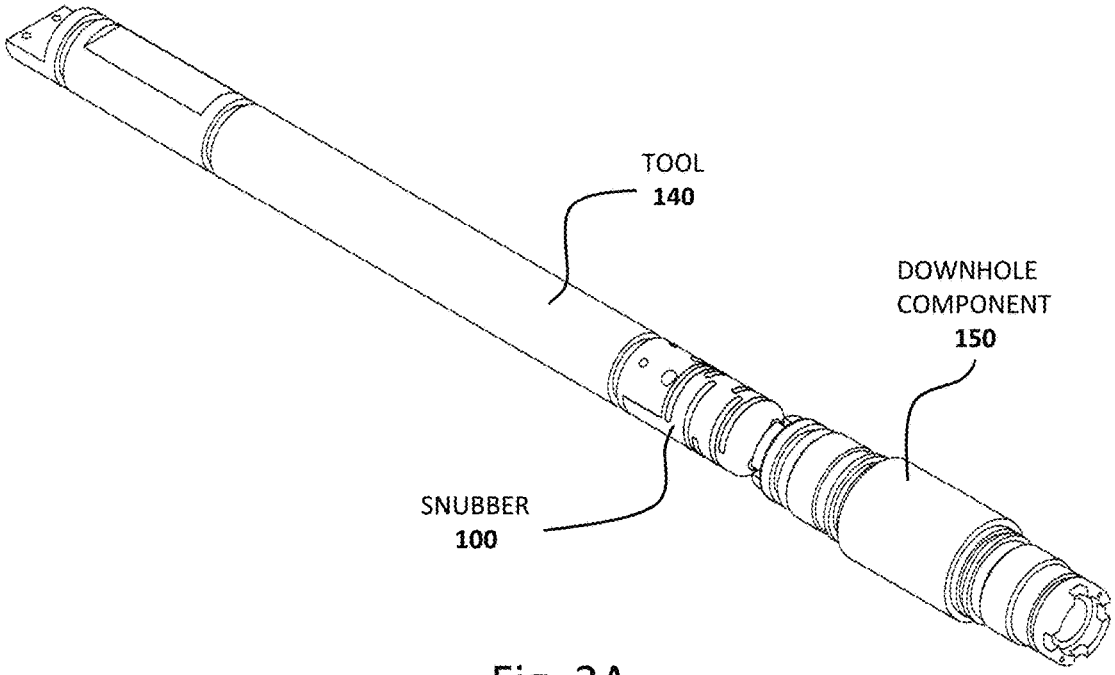
FIG. 3A is a perspective view of one embodiment of a snubber 100 connected between a tool 140 and a downhole component 150.
Figure 3B:
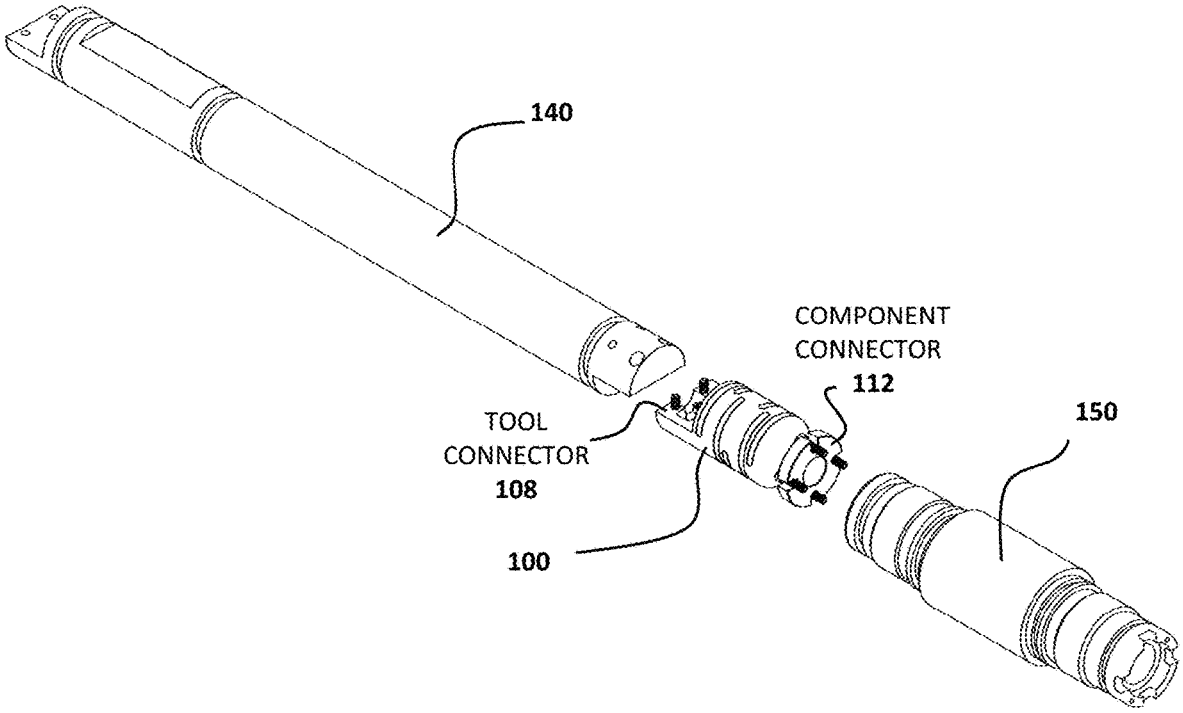
FIG. 3B is an exploded perspective view of the arrangement shown in FIG. 2A.
Figure 4A:
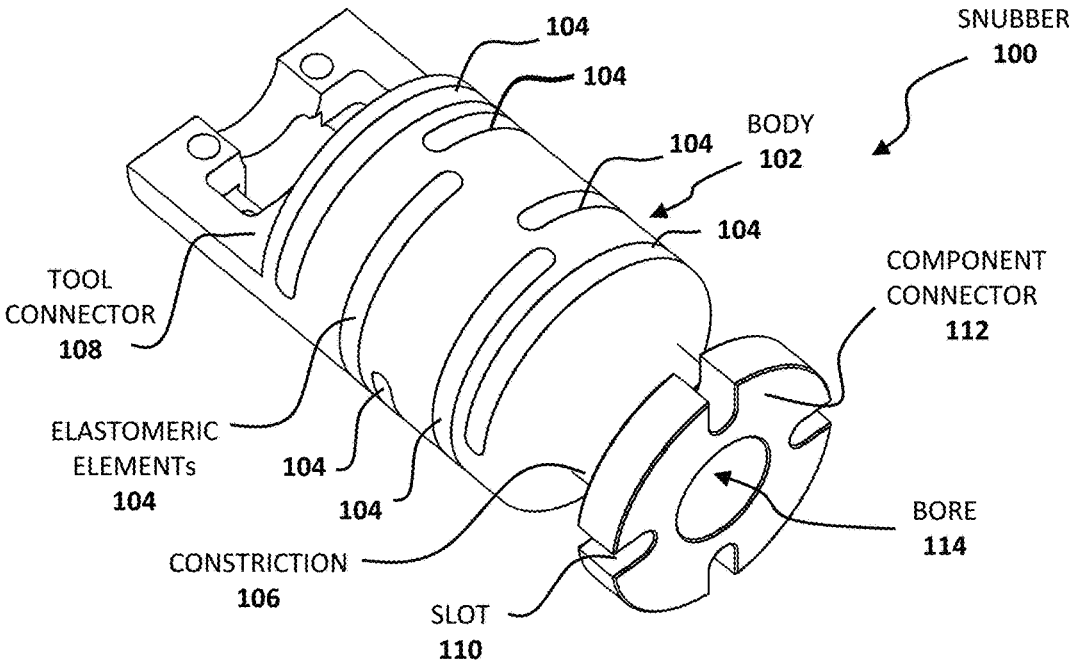
FIG. 4A is a perspective view of the snubber embodiment 100 of FIGS. 3A and 3B.

Example Embodiment 1—a Snubber with a Plurality of Main Body Cut-Outs and Elastomeric Elements Referring now to FIGS. 3A, 3B, 4A and 4B there is shown a first embodiment of a downhole shock absorbing device referred to herein as a snubber 100. In FIG. 3A, the snubber 100 is shown connected between a generalized module or tool 140 (upper end) and a generalized downhole component 150 in a perspective view. An exploded perspective view is shown in FIG. 3B, indicating that the snubber 100 has an uphole end with a half-cut-out tool connector 108 and a downhole component flange connector 112. FIG. 4A is a view of the snubber 100 by itself, more clearly showing that it is provided with a bore 116 extending completely across the length of the snubber 100 to provide a channel for conducting cables used for powering the drill bit and any other cables required for any operation performed by the drill string which require passage through the snubber 100 from the tool connector 108 to the component connector 112. This represents a useful advantage as the cables are not required to be routed alongside the snubber 100 as they are in conventional arrangements such as the arrangement shown in the prior art snubber device of FIG. 2B. The inventors believe that routing cables outside the body of a snubber increases the likelihood of damage to the cables. For example, during a type of radial drilling shock known as "stick-slip" the drill bit is obstructed and briefly stops rotating. The tools located above the drill bit have rotational inertia which, when halted, impart radial shock and torque on cables disposed alongside an outer sidewall of a snubber which can break the cables and cause short circuits which can cause serious tool malfunctions and lithium battery explosions in some cases. The inventors believe that placing the cables within a longitudinal bore of a snubber will provide some protection the cables from such shocks and damage. In addition, the provision of the bore 114 adds to the flexibility of the body 102, as will be described in more detail hereinbelow.

Furthermore, the bore 116 can accept and house larger cables than can be routed alongside the body of the snubber.

As a result, the provision of an axial bore 116 extending across the main body of the inventive device provides useful functionality to the snubber 100 and other snubber embodiments described hereinbelow.

The snubber 100 has a constriction 106 above the component connector 112 to facilitate installation of fasteners (not shown) via the four slots 110 formed in the component connector 112 which is in the form of a circular flange in this embodiment 100. It is shown more clearly in FIG. 4B that the main body 102 of the snubber 100 has a series of interleaved cut-out portions 114*a-g*. While this snubber embodiment 100 has seven cut-out portions 114*a-g* of substantially identical dimensions and variable placement along the length of the main body 102 of the snubber 100, alternative embodiments may include fewer or more cut-out portions which may vary with respect to dimensions. In such alternative embodiments some of the cut-outs may have reduced dimensions with respect to other cut-outs, for example.

The present snubber embodiment 100, wherein all seven of the cut-outs 114*a-g* have substantially identical dimensions, provides the advantage of requiring manufacture of a plurality of elastomeric elements 104 having the same dimensions to fit within the spaces of the cut-outs 114*a-g*.

In this snubber embodiment 100, the cut-outs 114*a-g* extend to the bore 116. As a result, all seven of the elastomeric elements 104 are substantially identical and have the shape of a half-circle with a central half-circle cut-away portion 105. While not specifically illustrated, it is to be understood that when an elastomeric element 104 is installed in one of the cut-outs 114*a-g*, the edge of its half circle cut-away portion 105 becomes aligned with the inner sidewall of the bore 116 thereby providing an inner bore 116 with a continuously smooth uninterrupted inner sidewall to facilitate threading of cables through the bore 116. If the elastomeric element 104 were to extend into the bore 116, it would interfere with threading cables through the bore 116. If the elastomeric element 104 did not extend as far as the edge of the bore 116, the cables would likely get caught in the remaining portion of the corresponding cut-out of cut-outs 114*a-g*, thereby reducing efficiency in threading the cables through the bore 116. The reduction of the volume of the main body 102 by the combination of bore 116 and the cut-outs 114*a-g* extending to the bore 116 provide the main body 102 with significant flexibility to move axially and bend laterally, while the elastomeric elements 104 provide the capacity to absorb shocks and vibrations. This provides another example of how the provision of an axial bore 116 extending across the main body 102 of the snubber 100 with end openings at the connectors 108 and 112 provides useful functionality to the snubber 100. This feature is also included in the other snubber embodiments 200 and 300 described hereinbelow.

In the snubber embodiment 100, the cut-outs 114*a-g* have widths which are slightly greater than the width of the elastomeric elements 104 to permit the elastomeric elements 104 to be manually pushed into the cut-outs 114*a-g* and held in place therein by frictional engagement with the walls of the cut-outs 114*a-g*. With this arrangement, the elastomeric elements 104 may be conveniently removed and replaced if it is deemed that excessive wear has reduced their effectiveness in absorbing shocks and vibrations and provided it is further deemed that the body 102 of the snubber 100 has generally retained its structural integrity.

As noted above, the cut-outs 114*a-g* extend to the bore 116. Alternative embodiments may have reduced dimension cut-outs which do not extend all the way to the bore and would be expected to be significantly less flexible for lack of connectivity of the cut-outs with the bore. In such embodiments, alternatively shaped elastomeric elements may be provided without cut-away portions which would be simple half circle shapes or shapes representing less than half a circle provided that the cut-outs have a shape less than half of a circle.

Figure 4B:
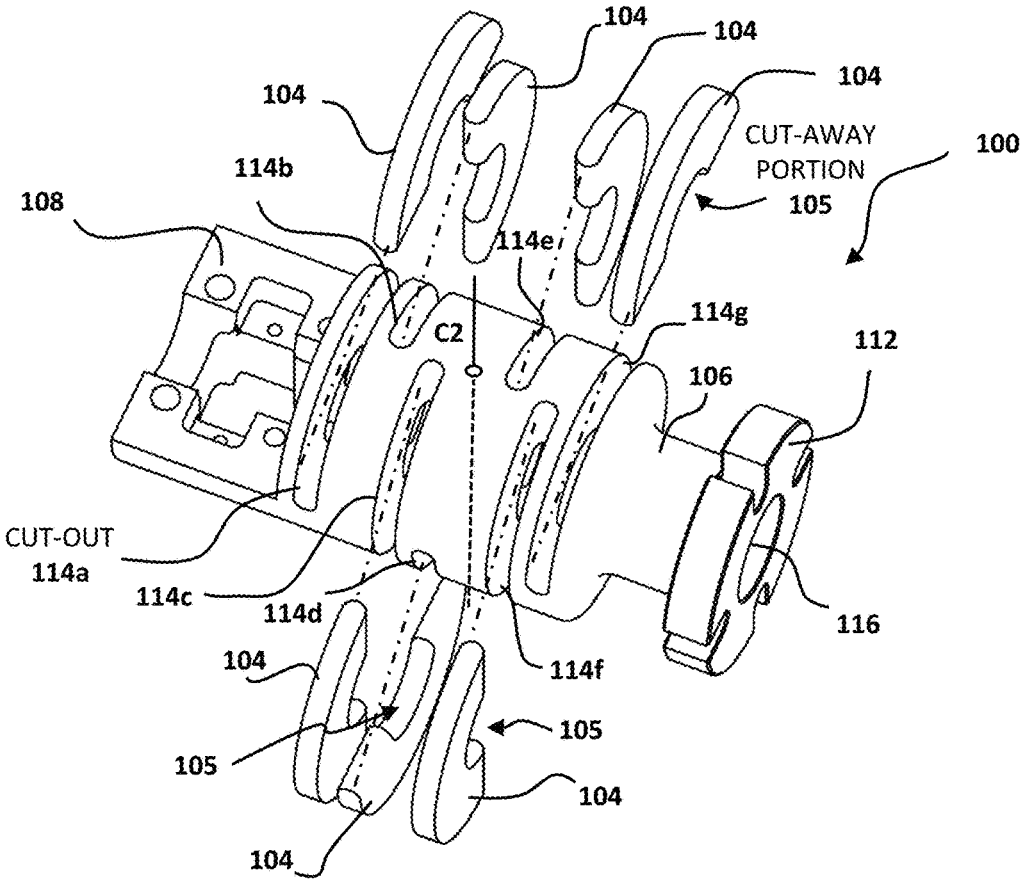
FIG. 4B is an exploded view of the snubber embodiment 100 with elastomeric elements 104 separated from the body 102 of the snubber 100.

It can be seen in FIG. 4B that in this particular embodiment, the cut-outs 114*a-g* are interleaved and adjacent cut-outs of the cut-outs 114*a-g* are is substantially equispaced with respect to each other along the length of the main body 102 between the upper connector 108 and the constricted portion 106 to provide consistent flexibility along the main body 102 (for greater clarity, the distance between cut-out 114*a* and cut-out 114*b* is substantially identical to the distance between cut-out 114*b* and cut-out 114*c*; the distance between cut-out 114*b* and cut-out 114*c* is substantially identical to the distance between cut-out 114*c* and cut-out 114*d*; the distance between cut-out 114*c* and cut-out 114*d* is substantially identical to the distance between cut-out 114*d* and cut-out 114*e*; the distance between cut-out 114*d* and cut-out 114*e* is substantially identical to the distance between cut-out 114*e* and cut-out 114*f*; and the distance between cut-out 114*e* and cut-out 114*f* is substantially identical to the distance between the distance between cut-out 114*f* and cut-out 114*g*). Adjacent cut-outs (for example cut-outs 114*a* and 114*b*) are offset by either 90 degrees or 180 degrees in either direction with reference to rotation about the central axis of the bore, using cut-out 114*a* as a reference. It can be seen in the perspective view of FIG. 4B that the leftmost cut-out 114*a*, extends around the top half of the circumference of the snubber 100 in the view shown; cut-out 114*b* extends around the back half of the snubber 100 in the view shown (representing a 90 degree offset towards the back of the snubber 100 with reference to cut-out 114*a*); cut-out 114*c* extends around the front half of the snubber 100 in the view shown (representing a 90 degree offset towards the front of the snubber 100 with reference to cut-out 114*a*); and cut-out 114*d* extends around the bottom half of the snubber in the view shown (representing a 180 degree offset to the bottom with reference to cut-out 114*a*). Cut-out 114*e* extends around the back half of the snubber 100 in the view shown (same orientation as cut-out 114*b*); cut-out 114*f* extends around the front half of the snubber 100 in the view shown (same orientation as cut-out 114*c*); and cut-out 114*g* extends around the top half of the snubber 100 in the view shown (same orientation as cut-out 114*a*). Therefore, the arrangement of cut-outs 114*a-g* within the main body 102 has C-2 rotational symmetry about axis C2 labelled in FIG. 4B (for greater clarity, this C-2 rotational symmetry applies only to the main body 102 and does not extend to the constricted portion 106 and the connectors 108 and 112) to provide uniform flexibility to the main body 102 of the snubber 100. Symmetrical placement of cut-outs along the length of the main body 102 may be advantageous for maintaining consistent structural integrity, but it is to be understood that alternative embodiments are possible wherein the cut-outs are not placed in a symmetrical arrangement.

In some embodiments, the snubber 100 has a main body, connector ends 108, 112 and constricted portion 106 formed in one piece construction from stainless steel, aluminum, beryllium, electrically nonconductive rigid plastics or composites thereof or other similar material deemed to be suitable for downhole applications. The elastomeric elements may be formed of materials including but not limited to Viton®, silicone, neoprene, and hydrogenated nitrile butadiene rubber (HNBR) which are provided with Shore A durometer hardness between about 60 to about 90. The snubber 100 is anticipated to be confirmed by testing to resist forces up to 1500 g.

This snubber embodiment 100 has the main body 102, the constriction 106, the tool connector 108 and component connector 112 in one piece monolithic construction and has flexibility in a range of motions as well as anti-rotation properties. The monolithic construction may be provided by casting the snubber as a single component formed of metal followed by machining of the cut-outs 114*a-g*, or by injection molding or 3D-printing of suitably durable plastics. The resulting snubber 100 may be compressed and extended relative to its normal resting position as well as laterally flexed.

Figure 5A:
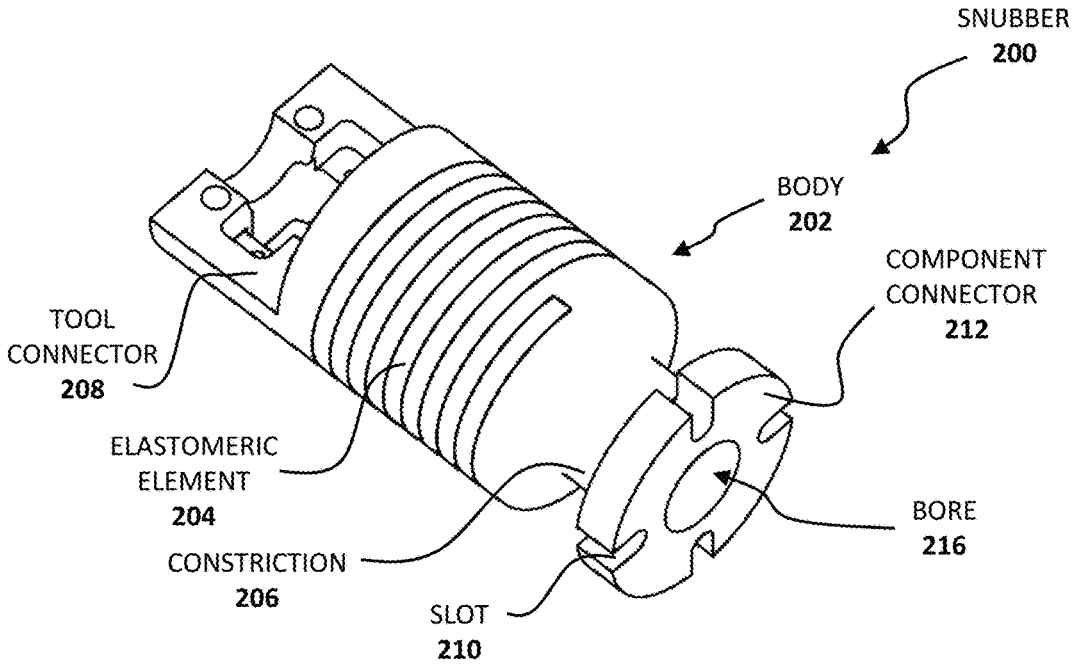
FIG. 5A is a perspective view of another embodiment of the snubber 200.
Figure 5B:
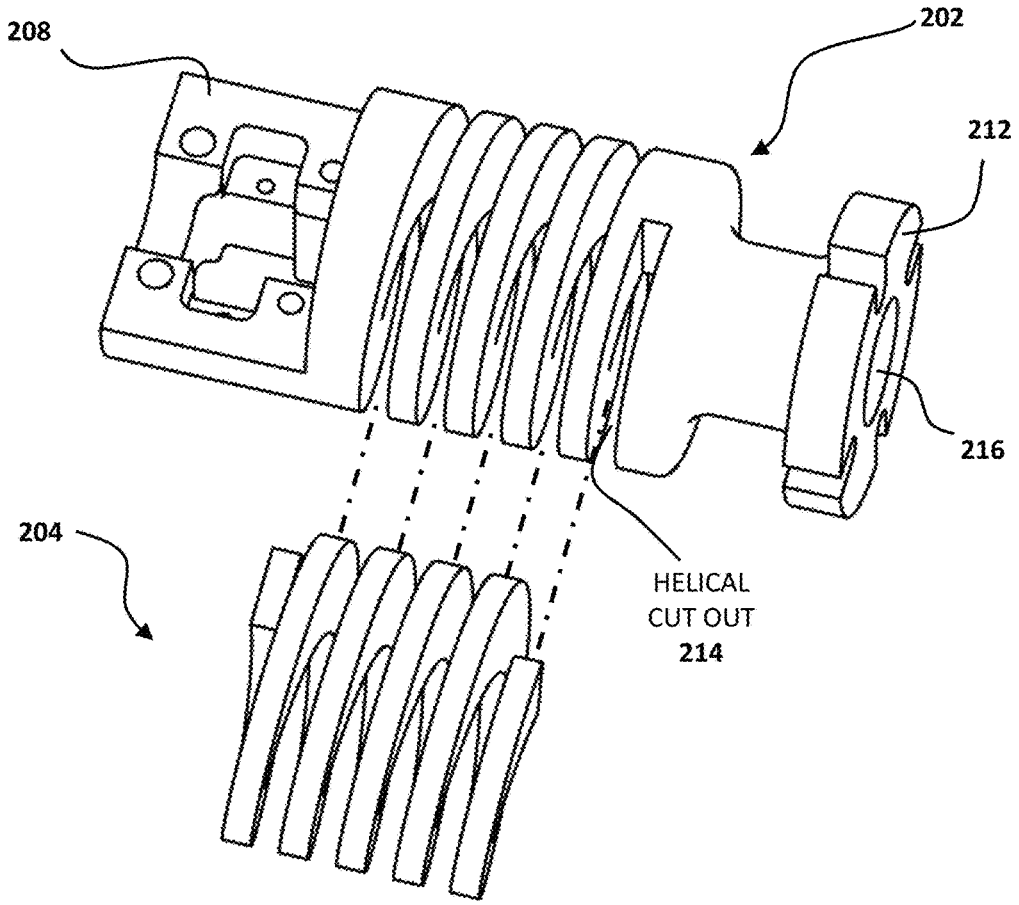
FIG. 5B is an exploded view of the snubber 200 showing the single elastomeric element 204 separated from the body 202 of the snubber 200 indicating the helical shape of the cut-out 216.

Example Embodiment 2—a Snubber with a Single Main Body Helical Cut-Out and Single Helical Elastomeric Element A second snubber embodiment 200 is shown in FIGS. 5A, 5B, 6A and 6B. FIG. 5A shows the snubber 200 by itself. It is seen that snubber 200 shares a number of features with the first snubber embodiment 100. Snubber 200 has a tool connector 208, a downhole component connector 212, a central bore 216 and a constricted portion 206 between the main body 202 and the downhole component connector 212 formed as a single monolithic piece by casting, injection molding or 3-D printing. Snubber 200 differs from snubber 100 in having a single helical cut-out 214 extending across essentially the entire length of the main body 202 which provides the effect of converting the body 202 to a structure resembling a coil spring. In this particular embodiment, the volume represented by the cut-out 214 represents about 50% of the volume of the main body 202 to provide the desired flexibility to the main body with respect to compression and lateral flexing and bending. The helical cut-out 214 receives a matched helical elastomeric element 204 which is installed manually and held in place by frictional engagement of the elastomeric element 204 with the edges of the cut-out 214. The helical cut-out 216 and the helical elastomeric element 204 both have 4.5 helical turns. Alternative embodiments based on this general embodiment may have a thinner helical cut-out and thinner elastomeric element with more than 4.5 helical turns, or a thicker helical cut-out and thicker elastomeric element with less than four turns. The helical cut-out 214 has helical turns providing a uniform channel with a width of about 0.125 inches (about 3.18 mm). A range of about 0.120 inches (about 3.0 mm) to about 0.130 inches (about 3.3 mm) is also acceptable. The inventors have deemed a helical cut-out within this range of width dimensions provides a suitable balance between provision of flexibility and shock absorbing capacity with ease of installation of the helical elastomeric element 214.

As described above for the first embodiment 100, it is to be understood that when the helical elastomeric element 204 is installed in the helical cut-out 214, the inner edges of the helical elastomeric element 204 become aligned with the inner sidewall of the bore 216 thereby providing an inner bore 216 with a continuously smooth uninterrupted inner sidewall to facilitate threading of cables through the bore 216. If the elastomeric element 204 were to extend into the bore 216, it would interfere with threading cables through the bore 216. If the elastomeric element 204 did not extend as far as the edge of the bore 216, the cables would likely get caught in the remaining portion of the corresponding cut-out of cut-outs 204, thereby reducing efficiency in threading the cables through the bore 216. The reduction of the volume of the main body 202 by the combination of bore 216 and the cut-out 214 extending to the bore 216 provide the main body 202 with significant flexibility to move axially and bend laterally, while the elastomeric elements 204 provide the capacity to absorb shocks and vibrations.

Figure 6A:
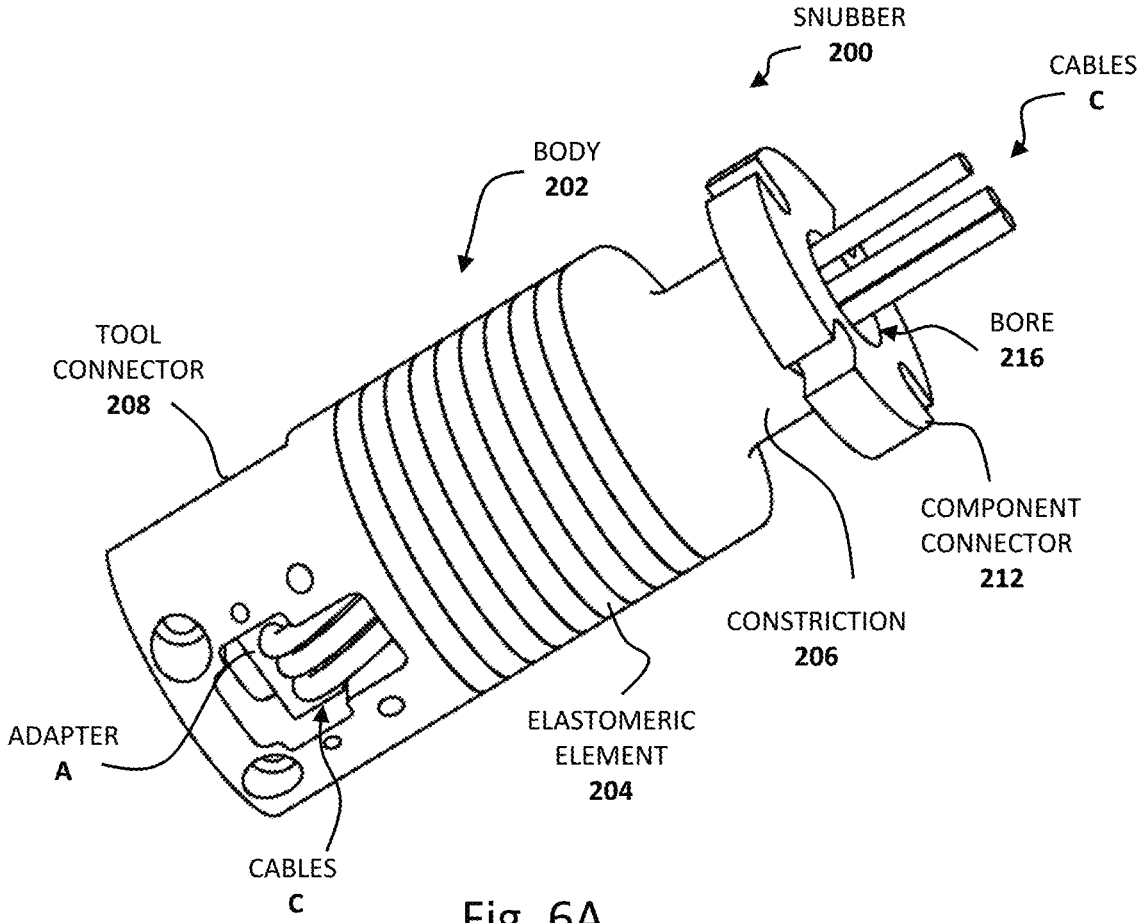
FIG. 6A is a perspective view of the snubber 200 showing mounting of an adapter A in a cavity of the tool connector 208 with cables C extending from the adapter A through the bore 214 and extending outward from the component connector.
Figure 6B:
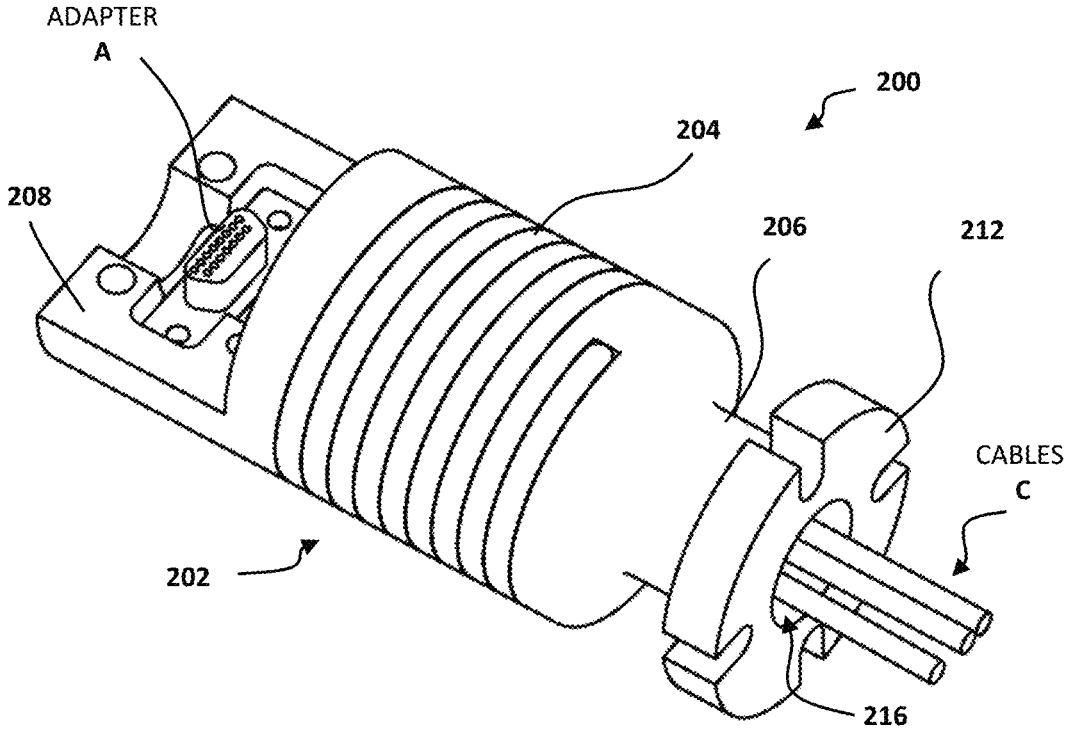
FIG. 6B is another perspective view showing the same arrangement of FIG. 6A.

FIGS. 6A and 6B show two perspective views of the snubber 200 with a set of cables C installed in the bore 216. FIG. 6A shows the cables C connected to an adapter A which rests in a cavity within the tool connector 208. The adapter A may be in the form of an MDM connector, for example whose interface is visible in FIG. 6B. This arrangement represents a significant improvement over the prior art arrangement shown in FIG. 2B with the cables running alongside the outer sidewall of the snubber. It is to be understood that the bore 216 extends from the tool connector 208 through the main body 202, the constricted portion 206 and exits through the component connector flange 212.

As described for snubber 100, some embodiments based on the structure of snubber 200 have a main body, a tool connector end 208, a component connector end 212 and a constricted portion 106 formed from stainless steel, aluminum, beryllium, rigid plastics or composites thereof or other similar material deemed to be suitable for downhole applications. The elastomeric elements may be formed of materials including but not limited to Viton®, silicone, neoprene, and HNBR which are provided with Shore A durometer hardness between about 60 to about 90. The snubber 200 is anticipated to be confirmed from testing to resist forces up to 1500 g.

This snubber embodiment 200 has the main body 202, the constriction 206, the tool connector 208 and component connector 212 in monolithic construction and has flexibility in a range of motions. The monolithic construction may be provided by casting the snubber as a single component formed of metal followed by machining of the cut-out 214, or by injection molding or 3D-printing of suitable plastics. The resulting snubber 200 may be compressed and extended relative to its normal resting position as well as laterally flexed.

Figure 7A:
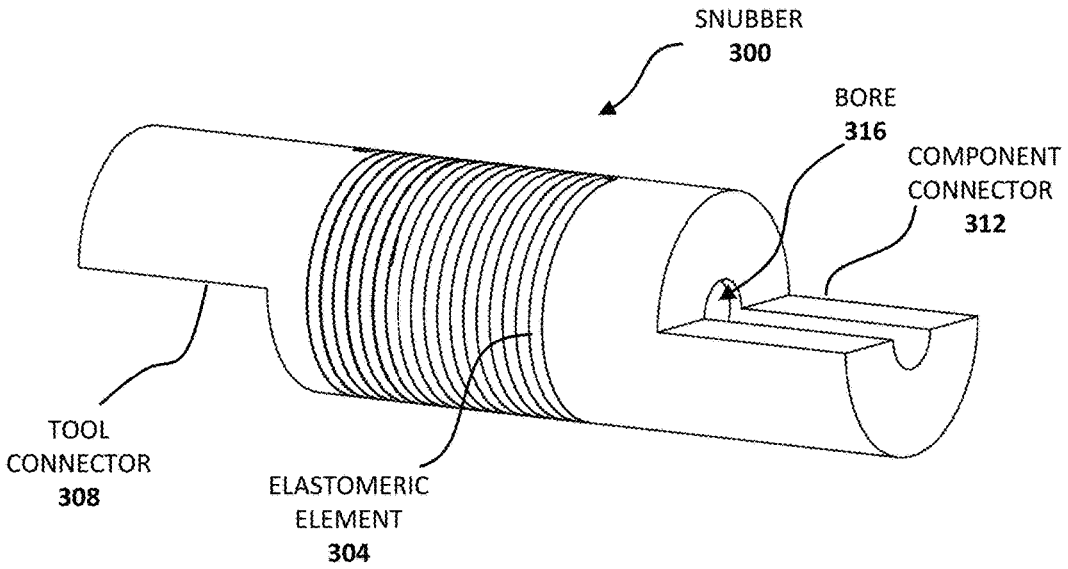
FIG. 7A is a perspective view of another snubber embodiment 300 with a different connector arrangement.
Figure 7B:
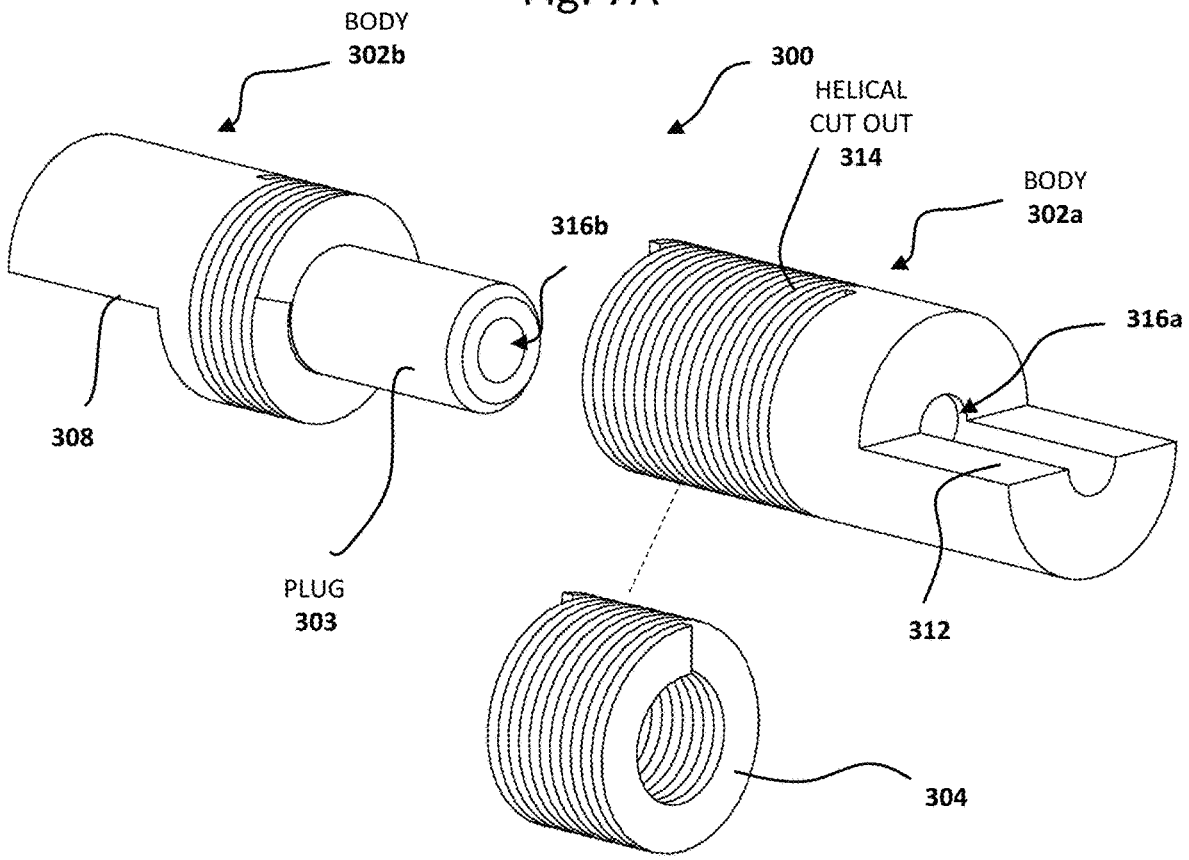
FIG. 7B is an exploded perspective view of the snubber embodiment 300 indicating that it has a body formed of two parts 302*a* and 302*b*.

Example Embodiment 3—a Snubber Having Two Main Body Parts, a Helical Cut-Out and Single Helical Elastomeric Element FIGS. 7A and 7B show a third snubber embodiment 300 which has two main body parts 302*a* and 302*b*. Body part 302*b* has a plug end 303 configured for insertion into a receptacle (not shown) within body part 302*a* to join parts 302*a* and 302*b* together to form a continuous main body which terminates with similar connector portions 308 and 312. Body part 302*a* has a helical cut-out 314 for installation of a helical elastomeric element 304. The cavity 316*a* of body part 302*a* joins with cavity 316*b* of the plug 303 to form a continuous bore to accommodate conducting cables (not shown) in a manner similar to the arrangement of FIGS. 6A and 6B. This snubber 300 is designed for use in a directional drilling arrangement and provides an example which uses similar connector ends which in this case are both half-cut-out connectors. The half-cut-outs are on opposite sides of the snubber 300 in order to provide a balanced center of gravity to the snubber 300.

Example Embodiment 4—Snubber Adapted for Connection to a Battery Module with a Cylindrical Connector and Having a Cylindrical Downhole Component Connector Downhole battery modules are used to provide electrical power to various downhole probes and instrumentation.

Battery modules which include a tube containing a series of cells are connected at each end to an adapter with ends configured for used for wiring the bottom or top of the battery packs. Typically, one or both ends are configured to hold a connector (such as an MDM connector, for example) to connect the battery module to the tool to which it provides power. These adapters are usually glued into the battery tube with an epoxy or silicone based compound. The inventors recognized that such battery module end adapters could be conveniently replaced by a similarly sized snubber having one or more of the snubber features described herein. This new concept provides the advantage of providing enhanced dampening of shocks and vibrations to protect the battery module, while making the required connections between the battery module and the downhole component for which it provides electrical power.

One example of such an embodiment is illustrated with reference to FIGS. 8A to 9D. This particular embodiment is suitable for use in a battery module 440 as part of an MWD system, wherein the cells of the battery module 440 provide power to the MWD system, which is located downhole from the battery module 440. However, it is to be understood that the same principles are applicable for protecting alternative battery modules providing power to other types of downhole probes and instrumentation.

Figure 8A:
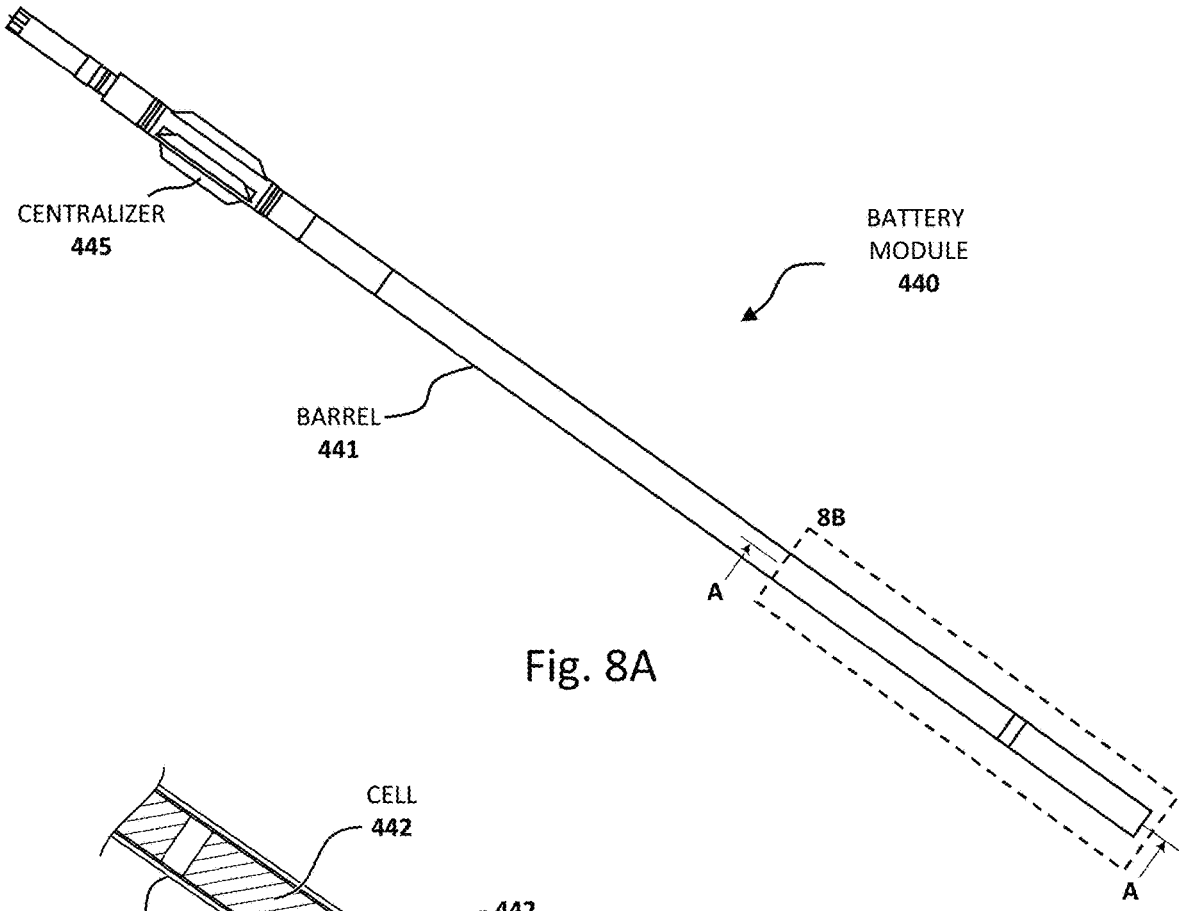
FIG. 8A is a side view of one embodiment of a downhole battery module 440.

FIG. 8A shows a typical arrangement of a downhole battery module 440 wherein the components contained therein are protected by an outer barrel 441. A centralizer 445 is shown at the uphole end of the battery module 440.

Figure 8B:
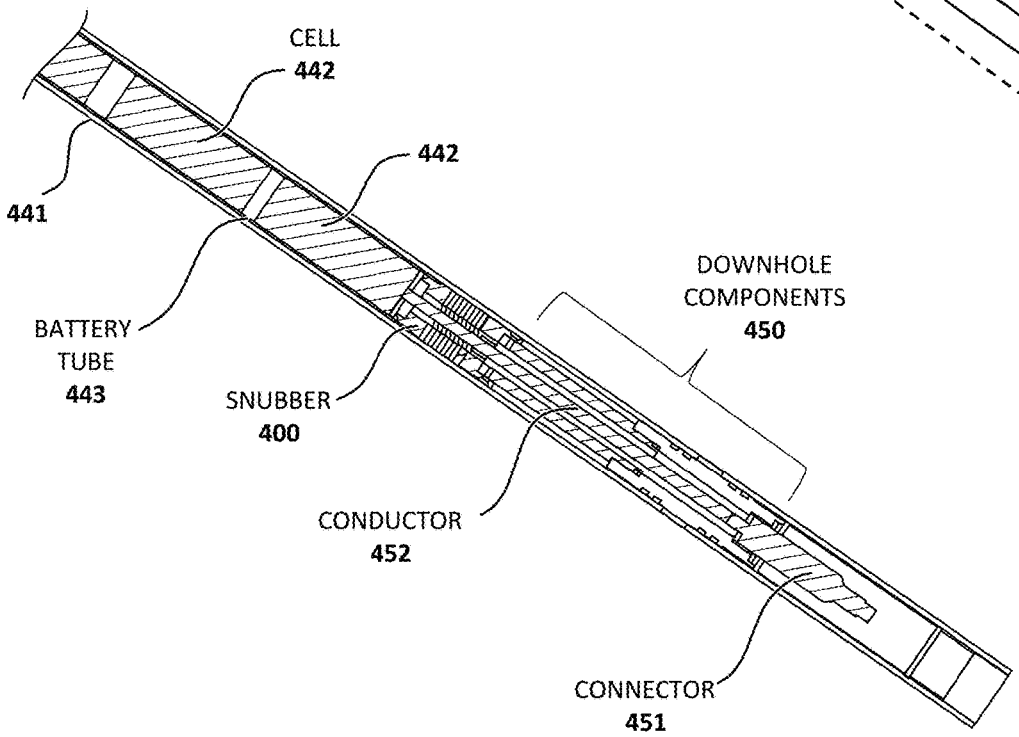
FIG. 8B is a magnified cross sectional view of a portion 8B of the downhole battery module 440 of FIG. 8A taken along line A-A showing the location of a snubber 400.

FIG. 8B shows a cross section of a portion 8B of the battery module 440. It is seen that the barrel 441 contains a battery tube 443 holding a series of cells 442. The snubber 400 is located between the battery tube 443 and downhole components 450 and a connector 451 of the electromagnetic MWD system.

Figure 8C:
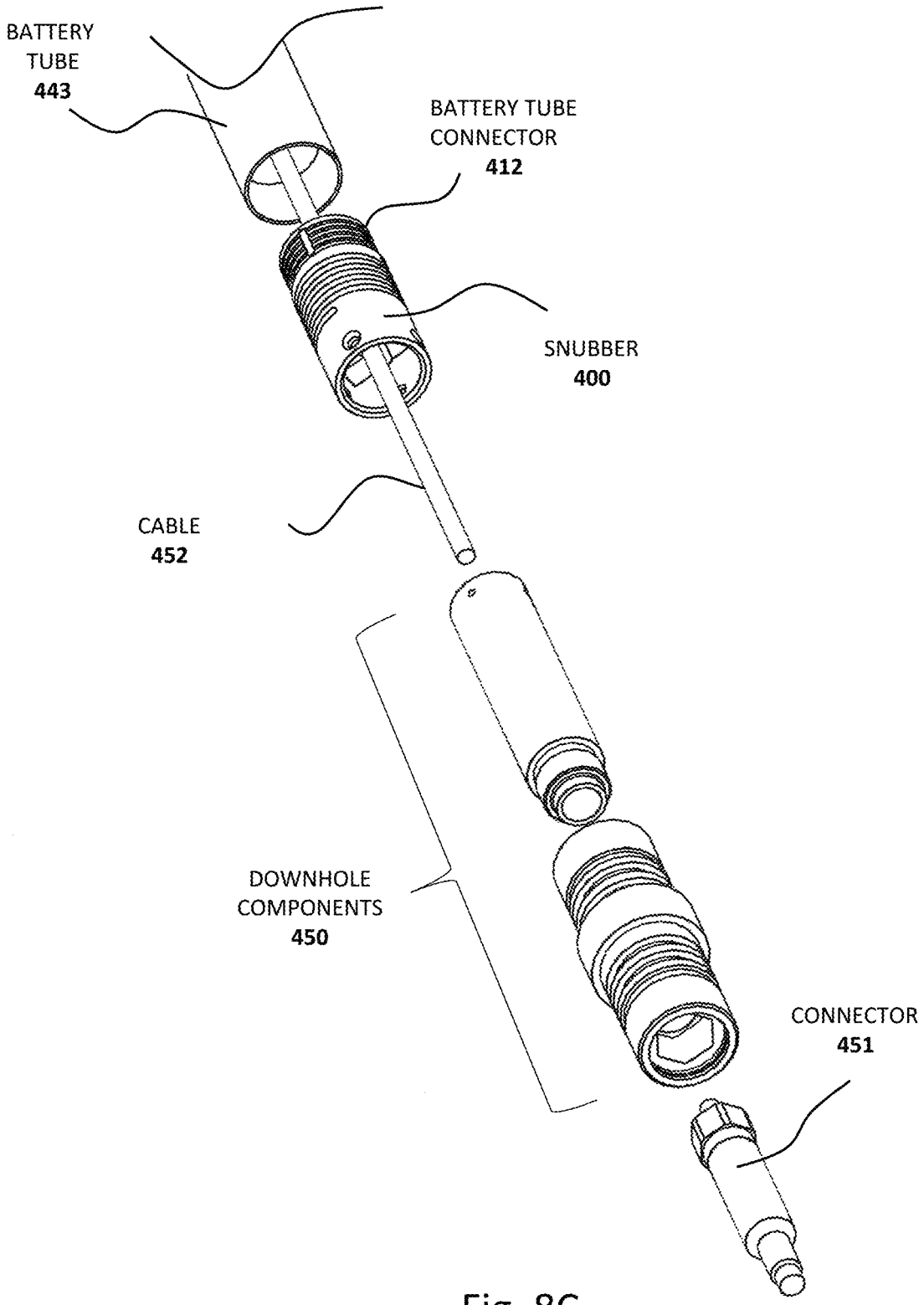
FIG. 8C is an exploded view of the arrangement shown in FIG. 8B.

FIG. 8C is an exploded view of the arrangement shown in FIG. 8B to more clearly show the location of the snubber 400 with respect to the battery tube 443 and the downhole components 450. The snubber 400 includes a battery tube connector end 412 which is configured to fit within the end cavity of the battery tube 443.

Perspective views of the snubber 400 are shown in FIGS. 9A to 9D. It is seen that this snubber embodiment 400 is formed of a monolithic body 402 having a central bore 416. The body 402 has a helical cut-out 414 containing a helical elastomeric element 404 functioning in a similar manner as in the other snubber embodiments 200 and 300 described hereinabove. It is seen that the body 402 has a reduced diameter end functioning as a battery tube connector 412. The battery tube connector 412 is provided with a series of ribs 413 to enhance fitting of the battery tube connector 412 into the battery tube 443, as well a series of 4 equi-spaced radiused recesses 410 provided for holding adhesive to retain the snubber 400 in association with the battery tube 443 and prevent rotation of the snubber 400 with respect to the battery tube 443.

Figure 9A:
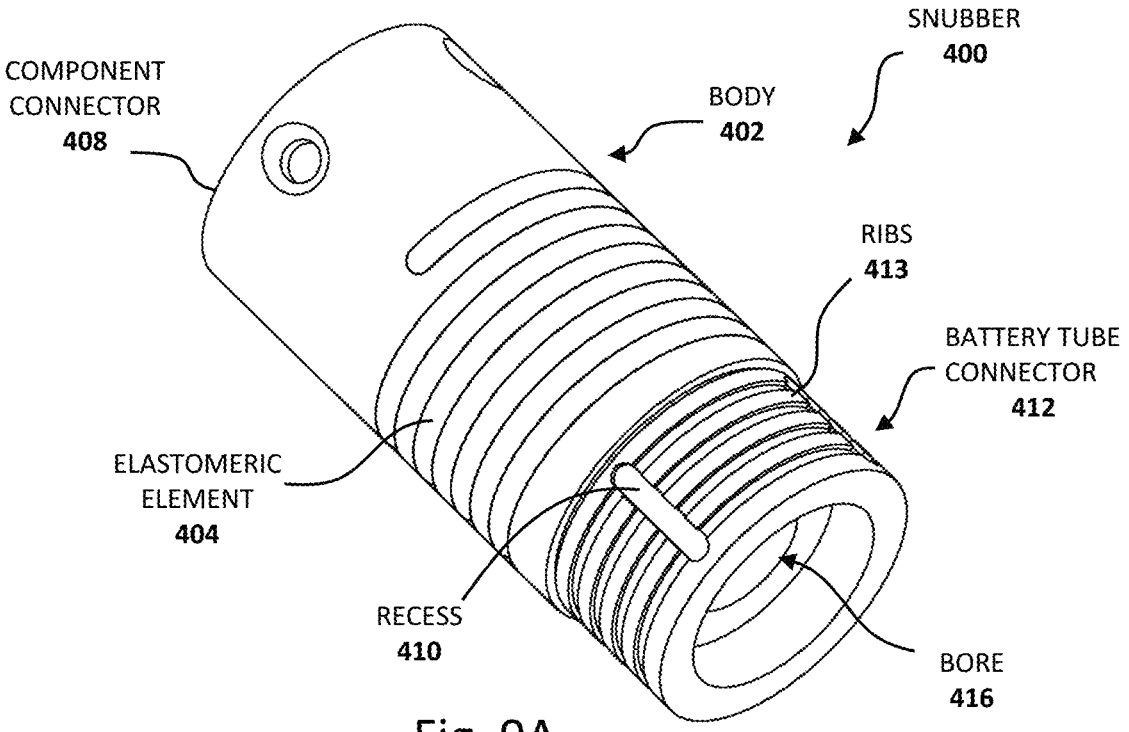
FIG. 9A is a perspective view of the snubber embodiment 400 of FIGS. 8B and 8C.
Figure 9B:
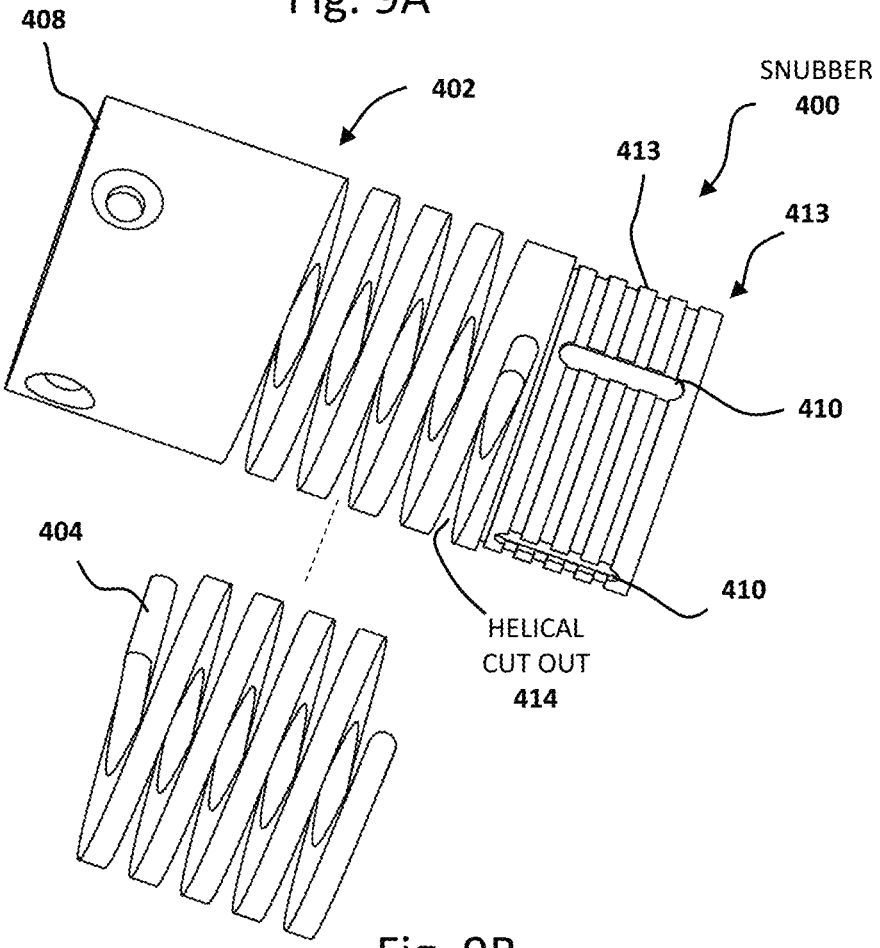
FIG. 9B is an exploded view of the snubber 400 showing the single elastomeric element 404 separated from the body 402 of the snubber embodiment 400 indicating the helical shape of the cut-out 416.
Figure 9C:
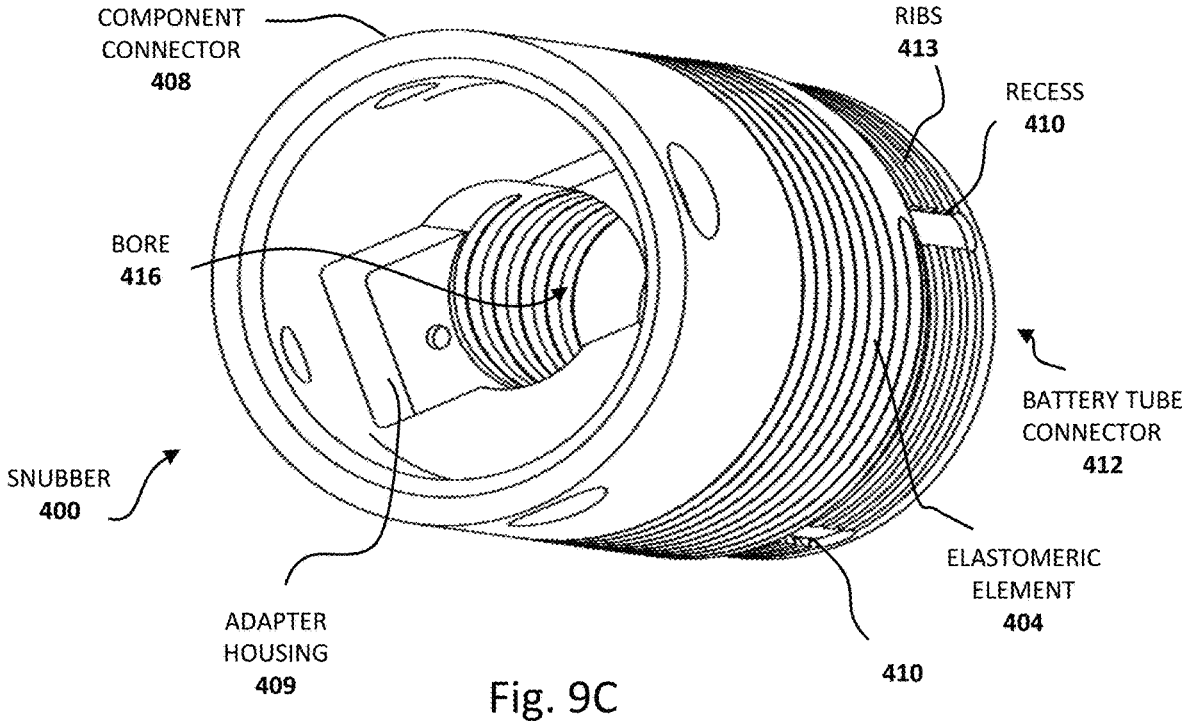
FIG. 9C a perspective view of the component connector end 408 of the snubber embodiment 400.
Figure 9D:
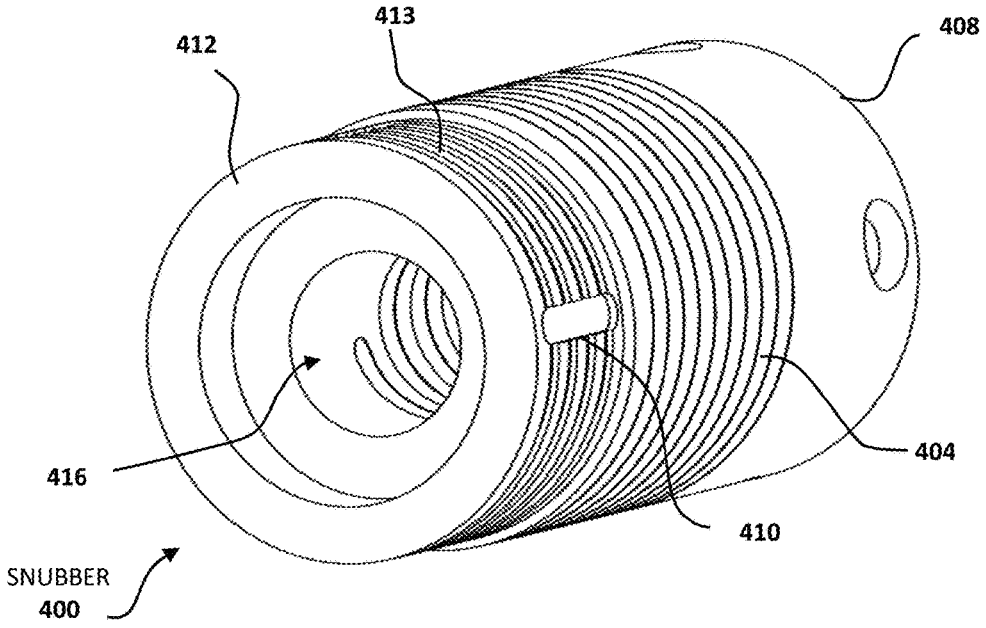
FIG. 9D a perspective view of the battery tube connector end 412 of the snubber embodiment 400.

The opposite end of the snubber 400 is the component connector end 408 which is configured to connect to the downhole components 450. The features of the component connector end 408 are best seen in FIG. 9C, where it is seen that the component connector end 408 has a wider diameter bore which transitions to a perpendicular wall shaped in the form of an adapter housing 409 for holding a cable adapter (such as an MDM connector) (not shown) connected to the conducting cable 452 (shown in FIG. 8C). Likewise, the features of the battery tube connector end 412 are illustrated in FIG. 9D. It is seen in FIG. 9D that the battery tube connector end 412 has a wider bore which transitions to a narrow bore.

Figure 10:
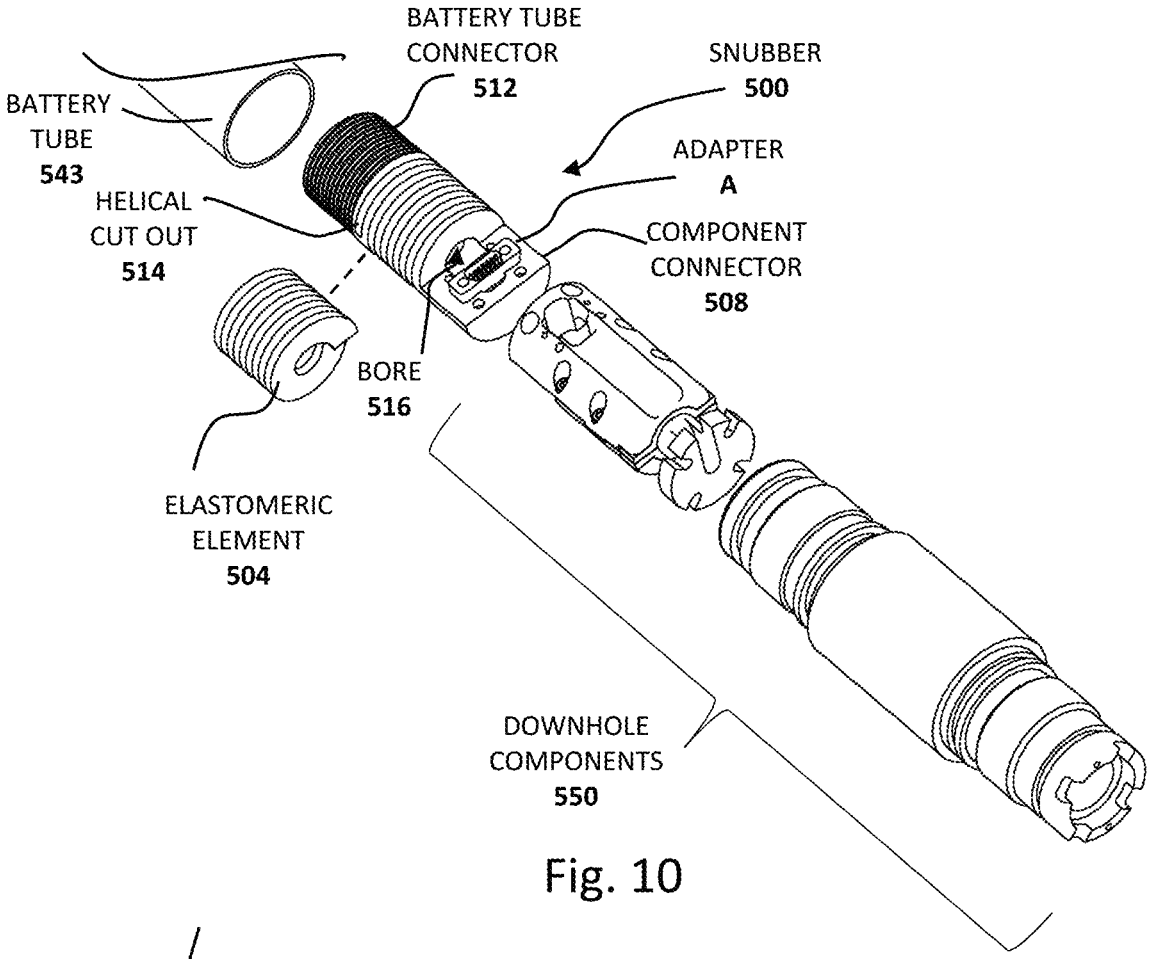
FIG. 10 is an exploded view of another arrangement including another snubber embodiment 500.

Example Embodiment 5—Snubber Adapted for Connection to a Battery Module with a Cylindrical Connector and Having a Cut-Away Downhole Component Connector Referring now to FIG. 10, there is shown another embodiment of a snubber 500 adapted for connection to a battery module. This snubber embodiment 500 is provided with a helical cut-out 514 to hold an elastomeric element 504 as described above for embodiments 200, 300 and 400. This snubber 500 has an upper cylindrical battery tube connector 512 which similar to the battery tube connector 412 of snubber 400. The battery tube connector 512 is configured to fit within the cylindrical end portion of battery tube 543. This snubber embodiment 500 differs from snubber embodiment 400 in having a downhole component connector 508 with a cut-away portion having a housing formed therein for holding an adapter A (such as an MDM connector for example). A bore 516 extends through the snubber 500 from the battery tube connector 512 to the downhole component connector 508. The bore 516 is used in the downhole assembly to hold conducting cables (not shown in this view). This downhole component connector 508 is configured to connect to one of a series of downhole components 550 which also has a complementary up-hole cut-away portion which faces downward away from view in the perspective shown in FIG. 10. This snubber embodiment 500 provides another example of how the features of the helical cutout 514, helical elastomeric element 504 and bore 516 can be incorporated into snubbers with different types of end connectors, to provide the capability to absorb shocks and vibrations as well as protecting cables (not shown) within the bore 516.

Figure 11:
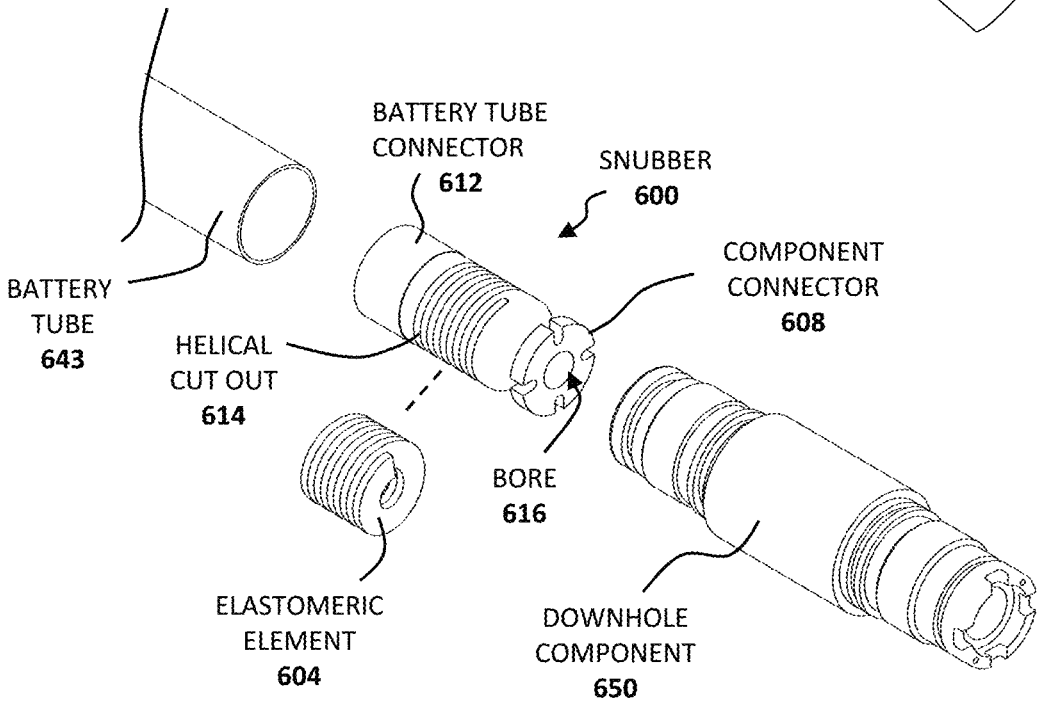
FIG. 11 is an exploded view of another arrangement including another snubber embodiment 600.

Example Embodiment 6—Snubber Adapted for Connection to a Battery Module with a Cylindrical Connector and Having a Flanged Component Connector Referring now to FIG. 11, there is shown another embodiment of a snubber 600 adapted for connection to a battery module. This snubber embodiment 600 is provided with a helical cut-out 614 to hold an elastomeric element 604 as described above for embodiments 200, 300, 400 and 500. This snubber 600 has an upper cylindrical battery tube connector 612 which similar to the battery tube connectors 412 and 512 of snubbers 400 and 500. The battery tube connector 612 is configured to fit within the cylindrical end portion of battery tube 643. This snubber embodiment 600 differs from snubber embodiment 500 in having a downhole component connector 608 with a restricted portion adjacent to a lower flange which is similar to the arrangement shown in snubber embodiment 200. A bore 616 extends through the snubber 600 from the battery tube connector 612 to the downhole component connector 608. The bore 616 is used in the downhole assembly to hold conducting cables (not shown in this view). This downhole component connector 608 is configured to connect via the flange to a downhole component 650. This snubber embodiment 600 provides another example of how the features of the helical cutout 614, helical elastomeric element 604 and bore 616 can be incorporated into snubbers with different types of end connectors, to provide the capability to absorb shocks and vibrations as well as protecting cables (not shown) within the bore 616.

Snubber Kits

The snubber embodiments described herein may be provided in the form of a kit which includes a snubber and a plurality of elastomeric elements to serve to replace one or more originally installed elastomeric elements. The kit may include a set of elastomeric elements having different hardness parameters ranging from between about 60 to about 90 (Shore A durometer scale). If desired, a user may install elastomeric elements of differing hardness for different applications or considering replacing a softer elastomeric element with a harder one if a given elastomeric element is found to wear out too quickly in a given application. Some alternative kit embodiments will include information about the hardness of the elastomeric elements as well as assembly instructions.

EQUIVALENTS AND SCOPE

The terms "one," "a," or "an" as used herein are intended to include "at least one" or "one or more," unless otherwise indicated.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art.

While the technology has been particularly shown and described with references to embodiments thereof, it will be understood by those skilled in the art that various changes in form and details may be made therein without departing from the scope of the invention encompassed by the appended claims.

The invention claimed is:

1. A snubber device for reducing shocks and vibrations in a downhole tool, the snubber comprising: a main body extending between upper and lower connector ends, the main body defined by one or more cut-out portions providing flexibility to the main body, one or more elastomeric elements dimensioned to be held within the one or more cut-out portions, wherein the main body is defined by a central longitudinal bore extending therethrough to provide a passage for one or more conducting cables associated with the tool;

wherein the cut-out portions are bounded by main body portions on top sides and bottom sides thereof and the main body portions extend from an outermost radial surface of the main body to the bore, wherein the one or more elastomeric elements are configured for lateral insertion into the cut-out portions, wherein, when inserted into the cut-out portions, the elastomeric elements occupy the cut-out portions such that inward facing surfaces of the elastomeric elements are in direct contact with the bore without extending into the bore, thereby providing the bore with a continuously smooth inner sidewall.

2. The snubber device of claim 1, wherein the main body is generally cylindrical.

3. The snubber device of claim 1, wherein either the upper connector end or the lower connector end comprises a reduced diameter portion terminating in a flange and the bore extends through the reduced diameter portion and the flange to extend the passage through the flange.

4. The snubber device of claim 1, wherein the one or more cut-out portions is a single cut-out portion and the one or more elastomeric element is a single elastomeric element.

5. The snubber device of claim 4, wherein the single cut-out portion is a helical cut-out portion and the single elastomeric element is a helical elastomeric element configured to fit within the helical cut-out portion.

6. The snubber device of claim 5, wherein the helical cut-out portion is defined by helical turns having a width of 0.12 inches (3.0 mm) to 0.13 inches (3.3 mm).

7. The snubber device of claim 1, wherein the main body and the upper and lower connector portions are of monolithic construction.

8. The snubber device of claim 1, wherein the elastomeric elements have Shore A hardness between 60 to 90 durometer.

9. A snubber device for reducing shocks and vibrations in a downhole tool, the snubber comprising:

a generally cylindrical main body extending between upper and lower connector ends, the main body defined by a helical cut-out portion, and a helical elastomeric element held within the helical cut-out portion wherein the main body is defined by a central longitudinal bore extending therethrough to provide a passage for one or more conducting cables associated with the tool; and wherein the helical cut-out portion is bounded by main body portions on top sides and bottom sides thereof and the main body portions extend from an outermost radial surface of the main body to the bore, wherein the helical elastomeric element is configured for lateral insertion into the helical cut-out portion, wherein, when inserted into the helical cut-out portion, the helical elastomeric element occupies the helical cut-out portion such that inward facing surfaces of the helical elastomeric element are in direct contact with the bore without extending into the bore, thereby providing the bore with a continuously smooth inner sidewall.

10. The snubber device of claim 9, wherein either the upper connector end or the lower connector end comprises a reduced diameter portion terminating in a flange and the bore extends through the reduced diameter portion and the flange to extend the passage through the flange.

11. The snubber device of claim 9, wherein the upper connector end is configured for connection to a downhole module.

12. The snubber device of claim 11, wherein the upper connector end is a reduced diameter cylindrical portion configured to connect to a tube holding a series of modules.

13. The snubber device of claim 11, wherein the lower connector end includes a housing formed in the body within the bore for holding a cable adapter.

14. The snubber device of claim 11, wherein the lower connector end comprises a reduced diameter portion terminating in a flange and the bore extends through the reduced diameter portion and the flange to extend the passage through the flange.

15. The snubber device of claim 9, wherein the helical cut-out portion is defined by helical turns having a width of 0.12 inches (3.0 mm) to 0.13 inches (3.3 mm).

16. The snubber device of claim 9, wherein the main body and the upper and lower connector portions are of monolithic construction.

17. The snubber device of claim 9, wherein the elastomeric element has Shore A hardness between 60 to 90.

18. A kit comprising a snubber device as recited in claim 1, and a plurality of replacement elastomeric elements.

19. The kit of claim 18, wherein at least some of the replacement elastomeric elements of the plurality of replacement elastomeric elements have different Shore A hardness from others of the plurality of replacement elastomeric elements.

* * * * *